US005097176A

United States Patent [19]

De Hair et al.

[11] Patent Number: 5,097,176

[45] Date of Patent: Mar. 17, 1992

[54] HIGH-PRESSURE SODIUM DISCHARGE LAMP HAVING A COLOR TEMPERATURE OF AT LEAST 2800° K.

[75] Inventors: Johannes T. W. De Hair; Johannes H. M. Van Der Sande; Robertus A. J. Keijser; Monique M. F. Eerdekens, all of Eindhoven, Netherlands

[73] Assignee: U.S. Philips Corporation, New York, N.Y.

[21] Appl. No.: 657,014

[22] Filed: Feb. 13, 1991

[30] Foreign Application Priority Data

Feb. 21, 1990 [NL] Netherlands ..... 9000409

[51] Int. Cl.[5] ..... H01J 17/28

[52] U.S. Cl. ..... 313/570; 313/573; 313/620; 313/634

[58] Field of Search ..... 313/570, 573, 620, 634, 313/640

[56] References Cited

U.S. PATENT DOCUMENTS 4,134,039 1/1979 Vida et al. ..... 313/640
4,490,642 12/1984 Dobrusskin et al. ..... 313/634
4,795,943 1/1989 Antonis et al. ..... 313/620
4,910,432 3/1990 Brown, et al. ..... 313/620
4,937,496 6/1990 Neiger et al. ..... 313/620
4,970,431 11/1990 Vegter et al. ..... 315/634

FOREIGN PATENT DOCUMENTS 0240080 7/1987 European Pat. Off. .

OTHER PUBLICATIONS

"A New High-Pressure Sodium Lamp with High Color Acceptability", H. Akutsu, Y. Watarai, N. Saito, H. Mizuno, Journal of IES/Jul. 1984, pp. 341-349.

"A New 50 W Super High-Pressure Sodium Lamp-Arc Tube Design and Energy Balance", Y. Ogata and N. Saito, Journal of IES/Summer 1988, pp. 105-117.

*Primary Examiner*—Donald J. Yusko
*Assistant Examiner*—N. D. Patel
*Attorney, Agent, or Firm*—Brian J. Wieghaus

[57] ABSTRACT

The invention relates to a high-pressure sodium discharge lamp which under nominal operating conditions radiates white light with a maximum color rendering index $R_a$ of more than 80. Since the wall load is above 80 W/cm$^2$ under nominal operating conditions, a color temperature $T_c$ of at least 2800° K. can be achieved with a luminous efficacy of more than 40 lm/W.

9 Claims, 1 Drawing Sheet

HIGH-PRESSURE SODIUM DISCHARGE LAMP HAVING A COLOR TEMPERATURE OF AT LEAST 2800° K.

CROSS REFERENCE TO RELATED APPLICATION

The present invention relates to U.S. application Ser. No. 657,003 filed concurrently herewith of Robertus A. J. Keijser and Monique M. F. Eerdekens which discloses and claims a high pressure sodium discharge lamp having a wall load of at least 60 W/cm$^2$, a gas filled outer bulb and a $D/_{di}<6$.

BACKGROUND OF THE INVENTION

The invention relates to a high-pressure sodium discharge lamp comprising a discharge vessel which is enclosed with intervening space by an outer bulb and has a ceramic wall, in which two electrodes with respective tips interspaced by a distance D are present, the discharge vessel having a substantially circular cross-section with an internal diameter $d_i$ at least over the distance D, while the outer bulb contains a gas filling, which lamp radiates white light with a colour temperature $T_c$ of at least 2500 K. under nominal operating conditions.

A lamp of the type described in the opening paragraph is known from DE-OS No. 31 29 329. The known lamp radiates white light under operating conditions and has a relatively high luminous efficacy. The colour rendering of the light radiated by the lamp expressed as the general colour rendering index $R_a$ is above 80 under certain conditions. In case of the colour rendering index $R_a<80$, the lamp can serve as a replacement for incandescent lamps. For this, however, it is desirable that the colour temperature $T_c$ should be considerably higher than 2500 K., since the colour temperature of incandescent lamps is between 2600 K. and 4000 K. Generally, light radiated by high-pressure sodium lamps can be regarded as "white" light if it falls within the region in the colour triangle bounded by straight lines through points having coordinates (X, Y), (0,400; 0,430), (0,510; 0,430), (0,485; 0,390) and (0,400; 0,360). The colour temperature in this case lies between approximately 2300 K. and 4000 K. By way of comparison it should be noted that the light of a standard high-pressure sodium discharge lamp, which radiates a golden-yellow light, has a $T_c<2200$ K. and an $R_a<50$. The luminous efficacy of this lamp, however, is considerably higher than that of the known lamp of the same power rating.

The known lamp has a high power rating, i.e. approximately 400 W or more, and thus has a relatively high luminous flux. The lamp can therefore only be used for large-scale illumination such as, for example, public lighting. A high-pressure sodium discharge lamp radiating light with very good colour characteristics ($T_c>2500$K., $R_a>80$) and so suitable as a replacement for incandescent lamps would seem to be highly suitable for interior lighting applications such as, for example, accent lighting. This requires a lamp of relatively small dimensions. Light with very good colour characteristics is also required for application in, for example, a motorcar headlamp. Here, too, relatively small dimensions of the lamp are desirable. Lamps of a relatively low luminous flux and relatively small dimensions are wanted for such applications. There is thus a demand for lamps having a relatively low power rating and relatively small dimensions for applications of the known lamp. A colour temperature of at least 2800 K. with the highest possible colour rendering value is required for this in a great number of cases. A reduction of the rated lamp power to below 400 W, however, leads to a considerable drop of the colour temperature to below 2200 K. and of the colour rendering index to far below 50 in the known lamp. In fact, the known lamp is then a standard high-pressure sodium discharge lamp, which does not generate "white" light.

An article in the Journal of IES, Summer 1988, pp. 105–117 describes a high-pressure sodium discharge lamp of relatively low power rating which under nominal conditions radiates white light with a $T_c$ of 2500 K. and an $R_a$ of about 80. The luminous efficacy is just under 40 lm/W. An increase in the colour temperature, whereby $R_a$ remains at least 80, is only possible through an overload, that is to say by increasing the power supplied to the lamp to above the rated power. However, this is accompanied by a sharp drop of the luminous efficacy on the one hand and a steep rise of the wall temperature of the discharge vessel to an undesirable level on the other hand. Under the overload conditions, a maximum $R_a$ is achieved at a colour temperature of 2700 K. The colour rendering deteriorates again when the colour temperature is further raised.

SUMMARY OF THE INVENTION

The invention has for its object inter alia to provide a means by which a lamp of relatively low power rating and relatively small dimensions can be obtained, which lamp radiates light with a colour temperature of at least 2800 K., a colour rendering index above 80, and a relatively high luminous efficacy under nominal operating conditions.

According to the invention, this object is achieved in that a lamp of the type described in the opening paragraph is characterized in that the ceramic wall of the discharge vessel has a wall load of at least 80 W/cm$^2$ under the nominal operating conditions of the lamp.

Thanks to the measure according to the invention, it is possible to obtain a high-pressure sodium lamp which radiates white light with a colour temperature $T_c$ of at least 2800 K. and a colour rendering index $R_a$ of more than 80 with relatively low power under nominal operating conditions. A luminous efficacy of at least 40 lm/W can be realised for power ratings up to 100 W, while a luminous efficacy of at least 45 lm/W is possible for power ratings of 100 W or more. The high wall load means that relatively small dimensions of the lamp can be readily realised.

It should be noted that the quantity "wall load" in the present description and claims is defined as the ratio of the rated lamp power in W to the internal surface area of the wall of the discharge vessel over the distance D.

A high-pressure sodium discharge lamp radiates light with a spectrum characterized by an absorption band near 589 nm surrounded on either side by spectral flanks having maxima at a mutual interspacing $\Delta\lambda$. If the radiated light has a colour rendering index $R_a$ above 80, the interspacing $\Delta\lambda$ is between approximately 40 and approximately 55 nm. It is known that a further widening of the absorption band, and thus a further increase of the interspacing $\Delta\lambda$, makes it possible to raise the colour temperature $T_c$ of the radiated light further. This, however, is to the detriment of the colour rendering and the luminous efficacy. In addition, broadening of the absorption band while the interior diameter of the discharge vessel remains the same implies an increase of the sodium pressure in the discharge vessel.

It is known per se from the literature (J. of *IES*, July 1984, pp. 341–349) that a high-pressure sodium discharge lamp can be designed which radiates light with a colour temperature $T_c$ above 2800 K. This, however, is realised by broadening of the absorption band. Such a rise in $T_c$ consequently entails a reduction in $R_a$ and in the luminous efficacy.

It is pointed out in this connection that the maximum achievable colour rendering index for practical high-pressure sodium lamps lies between 80 and approximately 85. Colour rendering depends on sodium pressure in this case. Starting from a standard high-pressure sodium discharge lamp radiating golden-yellow light, an increase in the colour rendering can be realised by an increase of the sodium pressure until the maximum $R_a$ value is achieved. A further rise in the sodium pressure leads to a fall in the $R_a$ again. The dependence on the Na pressure is relatively small near the colour rendering maximum.

A further increase of the sodium pressure is unfavourable from the point of view of lamp life, since it is especially the sodium pressure which affects the rate of the various corrosion processes in and of the discharge vessel.

In the present description and claims, the term ceramic wall is understood to mean a wall made of crystalline metal oxide or crystalline metal nitride which is highly resistant to the attack by Na at high temperature, such as, for example, monocrystalline sapphire, polycrystalline gas-tight sintered $Al_2O_3$ or polycrystalline gastight sintered ALN. The known wall materials can withstand temperatures up to approximately 1400 K. at the sodium pressure prevalent in the lamp for long periods. At temperatures which are considerably higher, there will be a considerable degree of corrosion of the ceramic wall under the influence of the prevalent sodium pressure. The use of a gas filling in the space between the discharge vessel and the outer bulb achieves an increased heat transfer, so that the temperature of the discharge vessel wall remains within acceptable limits also in the case of higher wall loads. Suitable gases are, for example, rare gases and nitrogen, since these are to a high degree inert under the prevalent conditions. The gas filling may consist of a single gas, but a mixture of gases is also possible. In those cases in which safety is of exceptional importance, the filling pressure is so chosen that the pressure of the gas filling is approximately one atmosphere under nominal operating conditions.

If the lamp according to the invention is used for accent lighting, the possibility to concentrate the radiated light into a beam is an important characteristic. Relatively small lamp dimensions are required for good beam characteristics of the light. Beam concentration is considerably promoted by a relatively small distance D between the electrode tips of the discharge vessel. In an advantageous embodiment of the lamp according to the invention the following is true: $D/d_i<3$. By choosing a low value for the ratio $D/d_i$ makes it possible to obtain a lamp of which the radiated light can be very well concentrated into a beam as a result of the relatively short discharge arc. The lamp thereby has a luminance of a correspondingly high value.

Increasing the wall load through reducing of D leads to a decrease of the lamp voltage and an increase of the lamp current. If the lamp is to be operated on a conventional public electricity mains, voltage transformation will be necessary under these circumstances. This takes place advantageously by means of an electronic circuit.

For reasons of exchangeability with the known lamp operated in existing installations, however, it is advantageous if the lamp voltage under nominal operating conditions lies between 80 and 100 V. A lamp according to the invention complies with this if $D/d_i>6$. Apart from the reduction of D, a reduction of $d_i$ also leads to an increase of the wall load. Reduction of $d_i$ results in an increase of the lamp voltage in this case.

A further improvement in the control of the maximum discharge vessel wall temperature can be achieved through the choice of the wall thickness. An increase in the wall thickness leads to an increased heat radiation of the wall and further promotes heat transport from the region between the electrodes to the relatively cool ends of the discharge vessel.

On the other hand, increasing the wall thickness adversely affects the lumen output. In addition, manufacture becomes more difficult with increasing wall thickness owing to an increasing risk of irregular crystal growth and an increasing risk of internal fractures. Therefore, the average wall thickness is preferably chosen to be smaller than 3 mm.

BRIEF DESCRIPTION OF THE DRAWINGS

An embodiment of a lamp according to the invention will be explained in more detail with reference to a drawing. In the drawing

DESCRIPTION OF THE PREFERRED EMBODIMENTS

Figure 1:
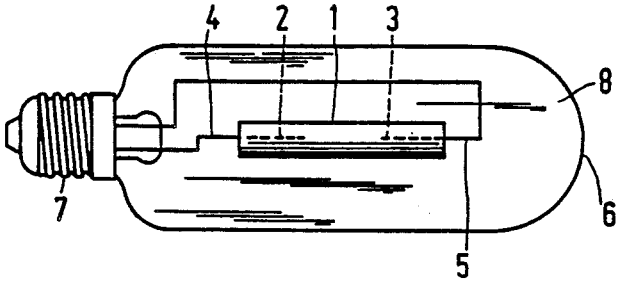
FIG. 1 shows a lamp provided with an outer bulb in side elevation.

In FIG. 1, reference numeral 1 denotes a discharge vessel having a ceramic wall which is enclosed with intervening space 8 by an outer bulb 6. The space 8 contains a gas filling. Two electrodes 2 and 3, whose respective tips are interspaced by a distance D, are present in the discharge vessel 1, which has a substantially circular cross-section between the electrodes 2 and 3. The electrodes 2 and 3 are each connected to a current supply conductor, 4 and 5, respectively. The outer bulb is provided with a lamp cap 7 to which the current supply conductors 4, 5 are connected. The discharge vessel, which has a filling of sodium, mercury and rare gas, has an internal diameter $d_i$ over the distance D.

Figure 2:
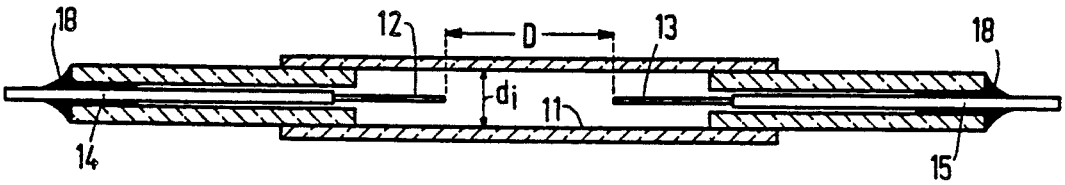
FIG. 2 shows a lamp in longitudinal section.
Figure 3:
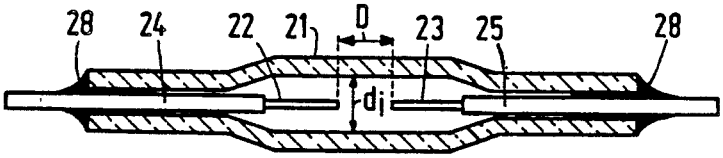
FIG. 3 shows another lamp in longitudinal section.

In FIGS. 2 and 3, corresponding parts have reference numerals which are 10 and 20 higher, respectively, than those in FIG. 1. The pin electrodes 12, 13 and 22, 23, respectively, are made of tungsten/rhenium (97/3 weight ratio), the current supply conductors 14, 15, 24, 25 are made of Nb. The discharge vessels 11, 21 are sealed off with melting ceramic 18, 28, respectively.

Lamps according to the invention were manufactured with discharge vessels having the shape according to FIG. 2. Data of the lamps are listed in the table.

TABLE

| lamp no. | 1 | 2 | 3 | 4 | 5 | 6 | 7 | 8 | 9 | A |
|---|---|---|---|---|---|---|---|---|---|---|
| D (mm) | 7 | 7 | 7 | 5 | 7 | 6 | 6 | 7 | 11 | 16.6 |
| $d_i$ (mm) | 3.5 | 3.5 | 3.5 | 3.5 | 3.5 | 3.5 | 3.5 | 3.5 | 1.7 | 3.5 |
| D/di | 2 | 2 | 2 | 1.4 | 2 | 1.7 | 1.7 | 2 | 6.5 | 4.7 |
| lamp voltage (V) | 42 | 40 | 42 | 28 | 39 | 36 | 33 | 36 | 93 | 90 |
| lamp power (W) | 90 | 90 | 95 | 90 | 65 | 75 | 70 | 125 | 55 | 53 |
| wall load ($W/cm^2$) | 117 | 117 | 123 | 164 | 84 | 114 | 106 | 162 | 93 | 29 |
| $T_c$ (K) | 3090 | 2930 | 3170 | 2900 | 2840 | 3020 | 2710 | 2910 | 2800 | 2500 |
| $R_a$ | 81 | 84 | 80 | 85 | 82 | 84 | 83 | 85 | 82 | 82 |
| luminous efficacy efficacy (lm/W) | 46 | 47 | 43 | 47 | 41 | 42 | 47 | 47 | 50 | 47 |
| wall thickness (mm) | 0.7 | 1.2 | 1.2 | 1.2 | 1.2 | 1.2 | 1.2 | 3.0 | 1.5 | 0.8 |
| max. wall temp. (K.) | 1575 | 1400 | 1430 | 1360 | 1280 | 1340 | 1280 | 1220 | 1370 | 1430 |

Data of a commercially available lamp (lamp A) have been included for comparison. This is a lamp of the Philips SDW 50 type.

The discharge vessels were filled with Na-Hg amalgam and xenon with a pressure of 53 kPa at 300 K. The weight ratio of the amalgam was Na/Hg 15/40. The space between the outer bulb and the discharge vessel was filled with $N_2$ in the lamps 1 to 8 at a pressure of 100 kPa at 300 K., and in lamp 9 with $N_2$ at a pressure of 50 kPa at 300 K. This corresponds to a pressure of approximately 1 atm. in lamp 9 under nominal operating conditions. Lamp A had a vacuum outer bulb. The discharge vessels of lamps 1 to 4 and lamp 8 had an internal length of 18 mm. The internal length of lamps 5, 6 and 7 was 16 mm. For lamp 9 the internal length was 17 mm and for lamp A 24 mm. Data of maximum wall temperature were obtained through D-line pyrometry as described in, for example, de Groot et al., "The High-Pressure Sodium Lamp", Deventer 1986.

It is apparent from the table that a considerably increased colour temperature combined with a colour rendering above 80 and a relatively high luminous efficacy at a relatively low rated power can be realised with lamps according to the invention.

The following explanatory remarks may be made. A comparison of the data of the lamps 1 and 2 shows that an increase in wall thickness at constant power leads to a lower maximum wall temperature. Lamp 2 then emits light with a colour rendering near the maximum under nominal operating conditions. Operation of lamp 1 at the same power leads to a higher colour temperature and a lower colour rendering. This points to an increased sodium pressure, which apparently lies well above the pressure belonging to the maximum colour rendering. The luminous efficacy does not change appreciably in this case.

A comparison of lamps 2 and 4 illustrates the influence of a reduction of the distance D between the electrode tips. This leads to a considerable drop in lamp voltage at a constant power. The colour temperature, colour rendering, and luminous efficacy are not subject to a substantial change. However, a clear drop in the maximum wall temperature takes place.

In lamp 3, which was identical to lamp 2, it is apparent that an increase of the power to above the rated power does lead to a higher colour temperature, but that this happens to the detriment of both the colour rendering and the luminous efficacy. The maximum wall temperature also rises appreciably.

The results of lamp 5, in which the internal length of the discharge vessel was reduced compared with lamp 2, clearly shows that maximum colour rendering is accompanied by a colour temperature which is approximately 100 K. lower than that in lamp 2. The accompanying lamp power is considerably lower, as is the maximum wall temperature.

A comparison of the data of the identical lamps 6 and 7 shows that the dependence of the colour rendering on the sodium pressure is relatively small near the colour rendering maximum. This means that also the power with which the lamp is operated is of relatively little influence on the colour rendering near the maximum thereof. Thus, while the colour rendering is maintained at approximately 83, the colour temperature can be chosen within a range with a width of approximately 300 K. A rise or drop of the colour temperature is then accompanied by a decrease or increase, respectively, in the luminous efficacy.

The wall thickness in lamp 8 is further increased compared with lamp 2. This leads to a considerably lower maximum wall temperature at a considerably higher lamp power while the values for colour rendering, colour temperature, and luminous efficacy remain at comparable levels.

In lamp 9 it was ensured that the lamp voltage was comparable to that of the existing lamp A at the same rated lamp power. A difference in lamp voltage of 3 V lies within the lamp voltage spread of mass-produced lamps of the Philips SDW 50 type.

We claim:

1. In a high-pressure sodium discharge lamp having a ceramic discharge vessel which includes a pair of electrodes disposed therein with respective electrode tips interspaced by a distance D, said discharge vessel having a substantially circular cross-section with an internal diameter $d_i$ over said distance D, an outer envelope enclosing said discharge vessel with intervening space therebetween, and a gas filling within said outer envelope, the improvement comprising:

said ceramic discharge vessel has a wall load $\geqq 80$ $W/cm^2$ during normal lamp operation; and said lamp has a color temperature $\geqq 2800°$ K. and a color rendering index $Ra > 80$.

2. In a high-pressure sodium lamp as claimed in claim 1, characterized in that $D/_{di} < 3$.

3. In a high-pressure sodium lamp as claimed in claim 1, characterized in that $D/_{di} > 6$.

4. An optimized high-pressure sodium discharge lamp having a high color rendering and high color temperature, said lamp comprising:

a sealed ceramic discharge vessel having a circular wall portion with a substantially constant inner diameter $d_i$;

a pair of pin electrodes disposed within said discharge vessel and spaced at opposite ends of said constant inner diameter portion of said discharge vessel to define a discharge gap of length D between them;

a pair of current-supply conductor each connected to a respective pin electrode and extending through said discharge vessel for permitting supply of electrical current to said pin electrodes;

an outer envelope enclosing said discharge vessel with intervening space therebetween and having a gas fill;

said ceramic discharge vessel having a wall load $\geqq 80$ W/cm$^2$, a color temperature $\geqq 2800$ K., a color rendering index Ra $\geqq 80$, and a luminous efficacy of $\geqq 40$ lm/W.

5. An optimized high-pressure sodium discharge lamp according to claim 4 having a power rating $\geqq 100$ W and a luminous efficacy $\geqq 45$ lm/W.

6. An optimized high-pressure sodium lamp as claimed in claim 5, characterized in that the ratio $D/_{di} < 3$.

7. An optimized high-pressure sodium lamp as claimed in claim 5, characterized in that the ratio $D/_{di} > 6$.

8. An optimized high-pressure sodium lamp as claimed in claim 4, characterized in that the ratio $D/_{di} < 3$.

9. An optimized high-pressure sodium lamp as claimed in claim 4, characterized in that the ratio $D/_{di} > 6$.

* * * * *